United States Patent [19]

Rasmussen

[11] Patent Number: 4,550,513

[45] Date of Patent: Nov. 5, 1985

[54] REPLACEABLE WEAR-EDGE ROUTER BIT

[75] Inventor: Robert Rasmussen, Rancho Palos Verdes, Calif.

[73] Assignee: Industrial Parts Depot, Torrance, Calif.

[21] Appl. No.: 607,243

[22] Filed: May 4, 1984

Related U.S. Application Data

[63] Continuation-in-part of Ser. No. 217,953, Dec. 19, 1980, abandoned.

[51] Int. Cl.[4] ..... D06F 79/00

[52] U.S. Cl. ..... 37/141 R; 172/719; 29/514; 29/521; 37/141 T

[58] Field of Search ..... 37/141 R, 141 T, 142 R, 37/142 A, 117.5, 124; 172/719, 777, 778; 29/DIG. 48, 514, 521

[56] References Cited

U.S. PATENT DOCUMENTS

| | | | |
|---|---|---|---|
| 2,732,639 | 1/1956 | Lillengreen | 37/141 R |
| 3,088,232 | 5/1963 | Gilbertson | 37/141 R |
| 3,520,076 | 7/1970 | Nichols | 37/141 R |
| 3,643,357 | 2/1972 | Benning et al. | 37/141 R |
| 3,719,790 | 3/1973 | Plockinger et al. | 37/141 R |
| 3,736,664 | 6/1973 | Black et al. | 37/141 R |
| 3,994,084 | 11/1976 | Smith et al. | 37/141 R |
| 4,208,815 | 6/1980 | Yunker et al. | 37/141 R |
| 4,208,817 | 6/1980 | Merkel | 37/141 T |
| 4,249,326 | 2/1981 | Merkel | 37/141 T |
| 4,290,214 | 9/1981 | Stepe | 37/141 T |

FOREIGN PATENT DOCUMENTS

| | | | |
|---|---|---|---|
| 1080937 | 10/1955 | Fed. Rep. of Germany | 37/141 R |

*Primary Examiner*—E. H. Eickholt

*Attorney, Agent, or Firm*—Beehler, Pavitt, Siegemund, Jagger & Martella

[57] ABSTRACT

A router bit for use with earth-moving equipment such as tractor scrapers, bucket loaders and dozers, composed of two parts, one affixed permanently to the apparatus and the other, which comprises the cutting edge, separable from the former for ease of replacement when worn and ineffective, thus obviating the need for expensive and laborious replacement of the whole router bit assembly. The upper and lower parts are joined by interlocking fingers and secured further by flex pins. The lower part, by means of a bar-like extension affixed to and positioned generally diagonally across the length of either side thereof, is prevented from lateral movement.

19 Claims, 9 Drawing Figures

Fig. 3
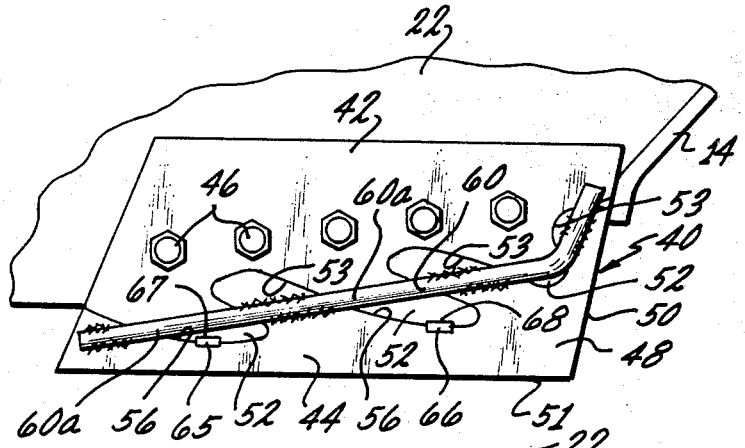
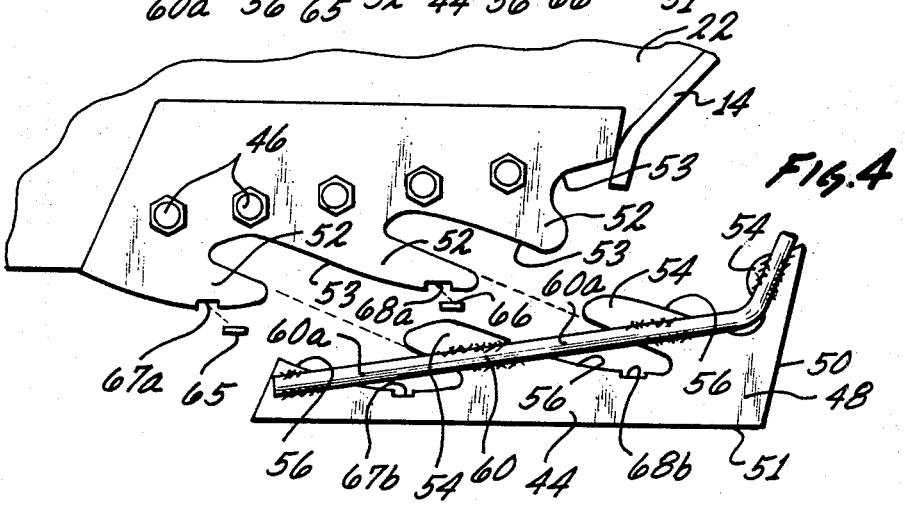
Fig. 4
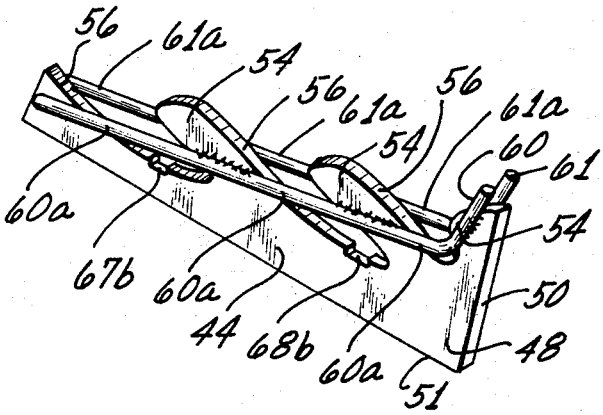
Fig. 5

REPLACEABLE WEAR-EDGE ROUTER BIT

This invention is a continuation-in-part of U.S. Application Ser. No. 217,953, filed Dec. 19, 1980 and now abandoned.

BACKGROUND OF THE INVENTION

1. Field of the Invention

This invention relates to a particular kind of router bit used with earth-moving equipment, e.g., tractor scrapers, bucket loaders, a dozer, and the like, for use in cutting into underlying terrain. More particularly, the present invention relates to an improved router bit having two parts, one of which may be permanently affixed to the earth-moving apparatus, while the other is separable from the former in order, inter alia, to reduce the ordinarily high cost of repair and replacement normally required when conventional unitary router bits become worn and ineffective.

2. The Prior Art

Most earth-moving apparatus includes a horizontally-elongated cutting edge for the purpose of cutting into the underlying terrain. This cutting edge is normally located in front of what is commonly called a scraper bowl, which is used to collect and hold the dirt sheared by the cutting edge. Secured to each side of the scraper bowl, adjacent and generally perpendicular to the cutting edge, are devices known as router bits. Router bits are used to slice vertically through the earth, perpendicular to the cutting edge, as the earth-moving equipment is being moved forwardly to ensure a clean cut and to protect the lower leading edges of the scraper bowl sides and the adjacent lateral ends of the cutting edge. If router bits are not provided, or if they are worn excessively, the lower leading edges, as well as the ends of the cutting edge, wear excessively, necessitating frequent time-consuming and expensive repair and, all too often, very costly replacement.

Conventional router bits are unitary in construction, normally manufactured by forging or casting, and are bulky because of the strength required for the bits. Normally, router bits are secured by bolts to the scraper side walls in order to perform their intended purpose, as aforesaid. Most conventional types of router bits will also include a metallic bar, or a thickened integrally formed rib which acts as a shield to protect the bolts from excessive wear due to the continuous passage of earth.

Conventional router bits, primarily because of their unitary construction, are often difficult to remove and expensive to repair and replace when they wear out. Replacement of router bits of a unitary structure involves taking the equipment out of service and loosening the bolts, known as plow bolts, and replacing the router bit. Since the router bits are of a unitary structure, a major portion of the bit is discarded. Normally four to five plow bolts hold each bit and the bolts are not readily accessible, are usually tightly installed requiring significant manual labor to loosen. Bolt threads may be damaged and bolt heads or nuts partially rounded, even though there may be bars or thickened edges which are intended to protect the bolt assembly. When such damage occurs to the bolt assembly because of the passage of dirt and rocks, replacement of the router bits may become a difficult chore.

Usually, the major portion of the upper section of a conventional router bit does not experience the degree of excessive wear that would require the need for constant repair and replacement of that particular part. Yet, because of its unitary construction, the entire router bit must be removed for repair and/or replacement even though only the lower portion is the only area affected and usually worn. In these situations, it is often necessary to replace, as well, the bolts used to secure the router bits to the scraper bowl sides. Naturally, this adds to the high cost of maintenance. Moreover, because router bits are usually formed of forgings, which are relatively expensive to fabricate and, thus, to replace, the constant expense and effort required to attend to their maintenance is rather high.

A typical prior art structure is that of U.S. Pat. No. 4,208,817 issued June 24, 1980 and the prior patents cited therein.

SUMMARY OF THE INVENTION

The present invention overcomes many of the problems associated with the maintenance and use of conventional router bits. Instead of a unitary construction, the present invention comprises a router bit having two separable portions, one being affixed to each of the side walls of the scraper bowl, while the other is separable therefrom and may be entirely disposed of when worn. The upper portion may be bolted or welded onto the side walls and may be used over a long period of time despite the fact that only the lower portion may require frequent repair or replacement.

The two portions may be joined through means of interlocking fingers and are further secured to one another by means that will be explained in more detail below. Lateral movement of the lower portion is prevented through the use of a metallic bar or similar device which may be welded or otherwise affixed onto each side thereof. When the two portions are joined together, the bars partially overlap and traverse the interlocking fingers in order to stabilize the lower portion to prevent against lateral movement. The bars also act to protect the bolts, when used in place of a weld.

Thus, there is a substantial reduction in material and labor expense in the event the router bit of the present invention becomes worn, since only the lower portion, rather than the entire device, including the usually much larger upper portion, will require replacement or repair. Since only the relatively smaller lower portion is replaced, the part may be fabricated of less expensive flat metal plate instead of expensive castings or forgings used to fabricate the bulkier conventional one-piece router bits. It is recognized in the art that the fabrication of router bits from flat metal plate, in contrast to expensive forgings and castings, offers significant economic advantages. Where economic savings in initial manufacture are added to the economic savings in replacement and repair, the improved router bit of this invention offers significant economic advantages.

Although the device of this invention is fabricated of flat metal sheet, the strength and effectiveness of the router bit of the present invention is not sacrificed. For example, when joined together, the two portions of the bit derive substantial strength from the interlocking finger arrangement. The bars which may be formed of relatively large diameter steel reinforcing rods which may be welded in place and which function to provide greater stabilization and to prevent lateral movement of the lower portion, in addition to protecting the bolt assembly.

In an alternative, easier to make embodiment a replaceable wear-edge router bit has a mounting member having a forward end and a rear end, and is adapted to be mounted as by welding to a piece of earth-moving machinery such as a bulldozer. A lower insert element which is detachable from the mounting member includes a portion which defines an earth-cutting edge. The mounting member and the insert each have a plurality of interlocking finger means and finger apertures. The finger means of the mounting member extend downwardly and forwardly, that is, point toward the ground and in the direction of forward movement of the earth-moving machine to which the router bit is to be mounted. The finger means of the insert point upwardly and rearwardly so as to interlock with finger means of the mounting member. Side plates are removably affixed to both sides of either the mounting member or the insert in an interference fit between the side plates to thereby prevent both lateral and forward movement of the insert relative to the first member.

In operation the greatest loads imposed upon the router arise from the downward weight of the earth-moving machine to which the router bit is mounted, which causes the router bit to cut into the underlying soil, and a horizontal force applied by forward motion of the machine which forces the router bit to plow forwardly through the soil. The primary forces on the insert are therefore in an upward and rearward direction. The disposition of the interlocking finger means is such that these primary forces urge the interlocking fingers against each other into firm engagement. Other forces operating on the router bit are lateral loads on the insert and forwardly directed forces acting on the insert, each of which forces alone would tend to bring about a disengagement of the interlocking fingers. In a preferred embodiment of the invention, these additional forces are counteracted by a pair of said plates, one plate being bolted to each side of the mounting member of the router bit so as to cover at least the interlocking portions of the both sets of fingers and thus hold the insert against lateral loads relative to the mounting member. The side plates may be curved and shaped so as to bite into the side surfaces of the insert and thereby retain the insert against forces acting forwardly on the insert which would separate the insert from the mounting member.

In a preferred embodiment of the invention the side plates are elongated members having a pair of long edges which are cut so as to form a corner of the line at intersection between the side surface and the long edge surface of each plate. The plates are shaped by a slight crowning so as to impart a concave bow to the plates between the long edges of the side plates on the side facing the interlocking fingers of the router bit. The side plates are mounted with the concave side against the side surfaces of the mounting member and insert, with the long edges lying transversely to the direction of the interlocking fingers. When the side plates are tightened against the mounting member and the insert by means of suitably mounting hardware, the inturned corners of the long edges grip the side surfaces on the insert.

The insert may be readily detached from the mounting member by loosening the bolts which tighten the side plates and hitting the rear end of the insert with a sledge hammer to bring about disengagement of the interlocking fingers, following which the insert drops away from the mounting member or can be easily removed.

This quick change replaceable router bit further improves over the prior art in that all of its major components can be constructed by cutting relatively inexpensive flat stock, such as steel plate, to make the mounting member, the insert, and the side plates. Only conventional bolts and nuts are required in addition to those components to make a complete router bit.

Other objects and advantages of the present invention will become apparent from the following specification taken in connection with the accompanying drawings.

BRIEF DESCRIPTION OF THE DRAWINGS

FIG. 3 is an enlarged fragmentary side elevation of the router bit of the present invention;

FIG. 4 is an enlarged fragmentary side elevation of the router bit of the present invention wherein the two sections are shown separately; and FIG. 5 is an isometric view of the lower section of the device of the present invention.

DETAILED DESCRIPTION OF THE PREFERRED EMBODIMENT

Figure 1:
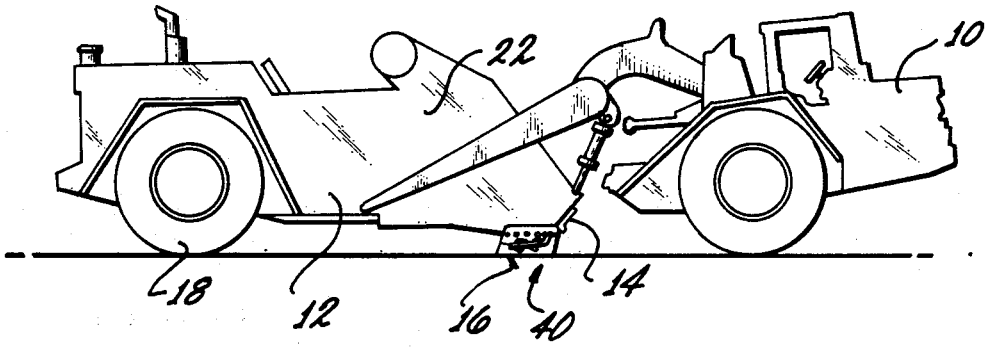
FIG. 1 is a side elevation of earth-moving equipment, namely, a tractor scraper, employing an embodiment of the present invention.

The preferred embodiment of the present invention may be attached to earth-moving equipment, such as the tractor scraper shown in FIG. 1. However, it will be understood that the present invention is not limited to use with tractor scrapers, but may also be employed as effectively in a variety of other earth-moving apparatus, such as, for example, dozers, bucket loaders, etc. The earth-moving equipment shown in FIG. 1 includes a tractor 10 and a trailing scraper bowl 12. The lower edge of the bowl 12 at the forward end 14 is provided with a horizontally-elongated scraper blade 16, which can be engaged with the underlying terrain by lowering the bowl 12 about a pivot axis defined by the centers of its rear wheels 18 in the conventional manner.

The bowl 12 has upstanding sidewalls 22. The blade 16 extends between the walls 22.

Figure 2:
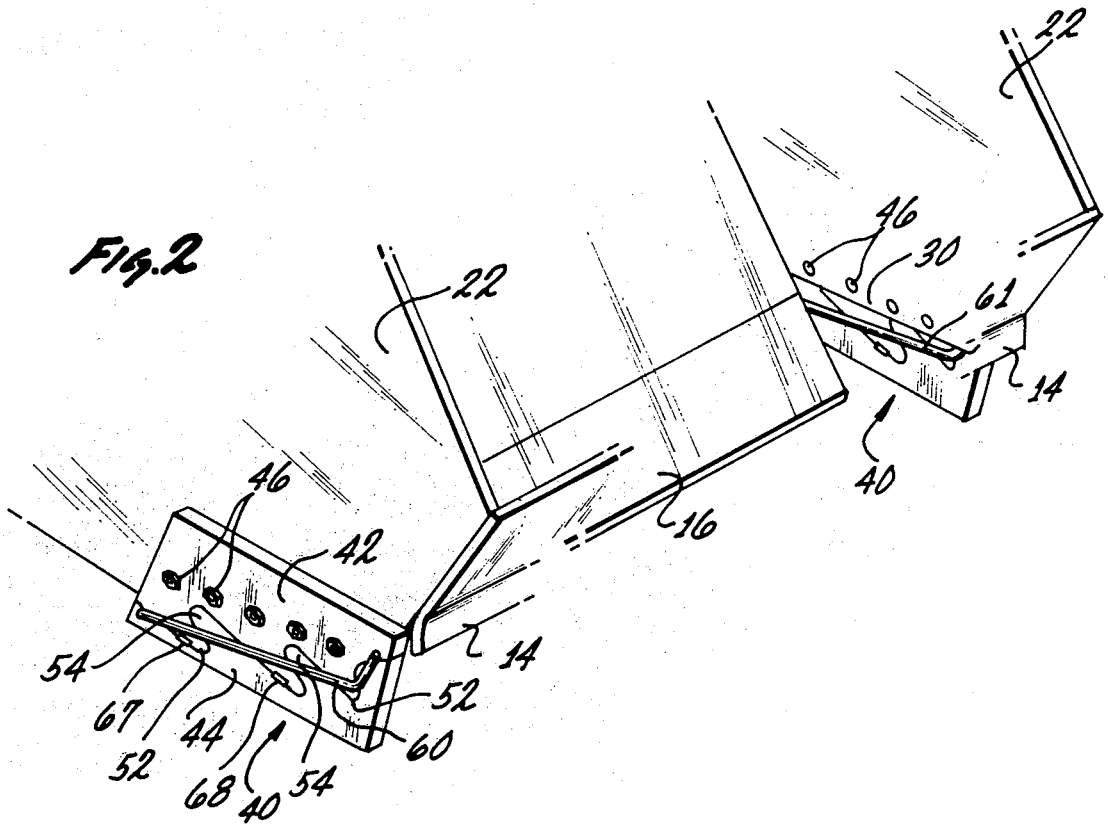
FIG. 2 is an enlarged view of the router bit of the present invention shown attached to each of the vertical sides of the scraper bowl used with earth-moving equipment.

Referring to FIG. 2, each sidewall 22, near the forward end 14 of the bowl, has a downwardly-extending lower edge 30. Along the length of the edge 30, on each of the sidewalls 22, a router bit 40 is provided. According to the invention, the router bit 40 is comprised of two parts 42, 44. Upper part 42 is generally affixed along edge 30 of sidewalls 22 by use of conventional means, such as plow bolts 46. Alternatively, section 42 may also be welded to edge 30. The lower part 44, also referred to as an insert, is separable from upper part 42 and may be of equal size to part 42, through the size of either section may vary depending on the circumstances.

Referring now to FIGS 3–5, the router bit of this intention is generally in the shape of a parallelogram when installed and includes a lower formed edge portion 48 which forms the forwarded cutting edge of the router bit. As wear takes place in normal usage of the router bit, it generally occurs in the area of the lower portion of vertical face 50 and the forward portion of the lower horizontal face 51 such that the cutting edge gradually becomes rounded and the wear tends to progress towards the rear. The type of wear pattern is typical of any router bit including that of the present invention.

In accordance with this invention, the router bit 40 is composed of two parts 42 and 44, as described, such that the cutting edge 48 is in the lower part or insert 44. Thus, when wear does take place, the lower part 44 of the router bit 40 is replaced, while the upper part 42 remains affixed to the side walls, as described.

One of the features of the present invention is the use of interlocking fingers to join the upper and lower parts of the router bit. Thus, as shown in FIG. 3, for example, the upper part 42 of the bit 40 includes a plurality of spaced fingers 52 extending generally in the direction of the lower forward edge portion 48 of the bit. Between the spaced fingers 52 are finger apertures 53 or portions of finger apertures. The lower part 44 of the bit also includes a plurality of spaced fingers 54, again with spaced finger apertures 56 therebetween.

As seen in FIG. 3, for example, the fingers and finger apertures of both the upper and lower parts of the bit are oriented such that the forces against the router bit, during its use, tend to urge the lower part 44 tightly against the upper part. Since the thrust forces are upwardly and rearwardly as shown by arrows in FIG. 3, the lower part 44 is forced upwardly and rearwardly, causing the lower part 44 to be urged upwardly and rearwardly in a locked position against the upper part 42.

To assure that the upper and lower parts 42, 44 of the bit remain together after assembly on the equipment, the finger surfaces and finger aperture surfaces of each part are formed parallel to the corresponding mating surfaces of the fingers and finger apertures, i.e., perpendicular to the plane of the router bit as shown, for example, in FIG. 5. Additionally, as mentioned, the fingers and finger apertures are oriented such that the rearward and upward forces generated during use tend to lock the two parts together.

Lateral movement of one part of the bit relative to the other, i.e., sidewise movement of the parts, is prevented by a pair of bars 60 and 61 which may, for example be a bent piece of reinforcing rod which is affixed to the fingers 54 of the lower part 44 or each side thereof, as shown in FIG. 5. As shown, the bars are formed to protect the plow bolts 46. Thus, when the lower part 44 is assembled to the upper part 42, fingers 52 of the upper part fit into the finger apertures 56, the latter bounded on each side by a portion **60*a* and 61*a* of the bars 60 and 61, respectively, which are located on each side of each of the finger apertures. When assembled, as seen in FIG. 3, the portions 60*a* and 61*b* of the bars overlying the finger apertures 56 operate to prevent sidewise movement of the fingers 52 in the corresponding finger apertures 56. One convenient way of affixing the bars, which function as side restraint guides to the lower part 44 of the bit 40** is by welding, although other means may be used.

While the bars are shown as being affixed to the lower part 44, they may just as easily be affixed to the upper part and still perform the same essential function. It is preferred, however, that the bars 60 and 61 be affixed to the lower part 44. Since the function of the bars in the present invention is twofold, i.e., to protect the plow bolts if used, and to prevent sidewise movement of the parts 42 and 44, it is preferred that the bars be part of the replaceable lower part 44 in order to assure proper protection to the plow bolts. Thus, as the bit and the bars are worn during use, there is an advantage to be able easily to replace both at the same time.

Another feature of this invention is the arrangement by which the upper and lower parts 42 and 44 of the bit are held together in use. While the fingers and finger apertures maintain the parts fixed against upward and rearward movement and the bars prevent lateral or sidewise movement as described, means also are provided to prevent forward movement of the lower part 44 relative to the upper part 42.

Referring to FIG. 3 and 4, at least two lock pins 65 and 66 are used. The lock pins may be in the form of "flex pins" which are separated elongated metal members with a resilient member such as rubber therebetween. The length of the flex pins is about equal to the cross-sectional thickness of the router bit. The flex pins are received in pin apertures 67 and 68 provided between the opposed faces of the sidewalls of the fingers and finger apertures. Half of each pin aperture **67*a*, 68*a* is formed in the finger and half 67*b*, 67*b*** in the opposed finger aperture.

Referring to FIG. 4, the lower part 44 is assembled to the upper part by sliding the lower part from right to left as seen in FIG. 4, i.e., in the rearward direction.

When properly positioned, each half of the respective pin apertures are aligned and the pins are driven in place. The pins are proportioned to provide an interference fit in the apertures and as they are driven into the apertures, the resilient member is compressed and the pin is securely in place.

In order to prevent forward movement of the lower part 44 relative to the upper part, the pin apertures 67 and 68 are provided between the tip and base of the fingers, i.e., half the aperture is provided between the tip and base of finger 52 and the other half is provided between the end and the base of the finger apertures, each portion being located to be aligned when the parts 42 and 44 are assembled. Since forward movement of the lower part 44 relative to the upper part involves sliding movement of the fingers relative to the finger apertures, the pins 65 and 66 function to prevent such forward sliding movement. Rearward movement is prevented, as described, by the fingers which are bottomed against the base of the corresponding finger holes.

As will be apparent from the foregoing, replacement of the router bit in accordance with this invention is comparatively simple compared to prior art router bits. By this invention, only the lower part 44 of the bit is replaced, resulting in a significant savings because the entire router bit, including the unworn portion, is not replaced and discarded. The estimated savings of the replacement insert, i.e., the lower part, as compared to the entire bit, is about 60%. Further, the comparative simplicity of the replacement operation results in lower maintenance costs both in the actual installation and in the costs of the item replaced.

The replacement part is shown in FIG. 5 and is essentially the lower part 44 of the bit, and the locking pins. To replace a worn bit of in accordance with the present invention, the pins are driven out and lower part is moved left to right as shown in FIG. 4. Thereafter the new replacement lower part 44, shown in FIG. 5, is assembled by moving it right to left as shown in FIG. 4. The pins are then driven into place, the pins preferably oriented so that the metal ends face forward and to the rear, and replacement is complete.

Another practical advantage of the router bit of the present invention is the savings in cost and savings in manufacture thereof. In a preferred form, the router bit is formed of metal plate rather than being cast or forged. As compared to a casting or a forging, metal plate is currently less expensive. Further, the router bit of this invention is less bulky than the prior art castings which for strength reasons tend to be bulky.

In manufacture, the plate may be cut by a tracer torch with an electric eye to provide the parts, as decribed, or merely the lower part. The bars are of reinforcing rod, cut to length, formed and welded in place on the lower part, as described. As will be appreciated, the number, shape and size of the fingers and finger apertures may vary from those described here without departing from the present invention. It is also understood that the size and overall shape of the router bit of this invention may be varied as desired, e.g., more material at the cutting edge or an extended cutting edge. The router bit of this invention may be welded or bolted in place, as desired. The bars may be secured in place other than by welding.

While it is preferred to form the router bit out of plate for present reasons of economy, it may be advantageous to form the parts of the router bit by other fabrication techniques.

It will also be apparent that the router bit of the present invention may be sold as a complete assembly for replacement of current prior art bits or as original equipment. It is also apparent that the lower part of the router bit in accordance with this invention also possesses separate utility as a replacement part and may be separately made and sold.

Figure 6:
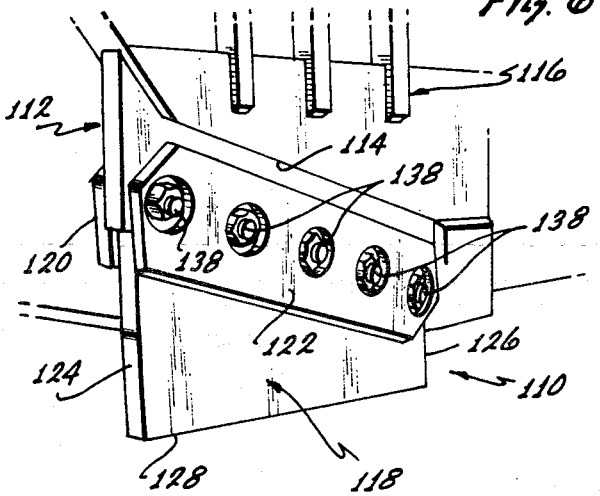
FIG. 6 is a perspective view of a quick change replaceable router bit according to this invention mounted to a piece of of earth-moving equipment, namely, the scraper bowl of a tractor, shown only in part.

An improved quick change replaceable router bit 110 shown in FIG. 6 includes an upper mounting member 112, which is welded along its upper edge 114 to a portion 116 of a piece of earth-moving machinery. A lower insert member 118 is secured in co-planar relationship to the mounting member 112 by means of side plates 120, 122 in a manner to be described. The router bit has a forward edge 124, a rear edge 126, and lower earth-cutting edge 128.

Figure 7:
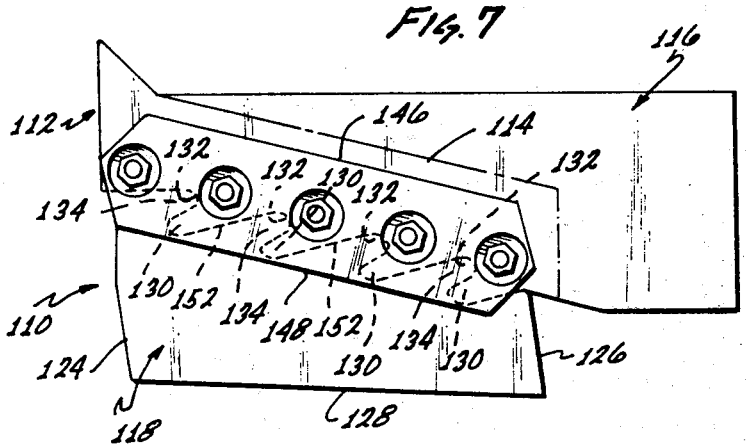
FIG. 7 is a view taken in side elevation of the quick change replaceable router bit.
Figure 8:
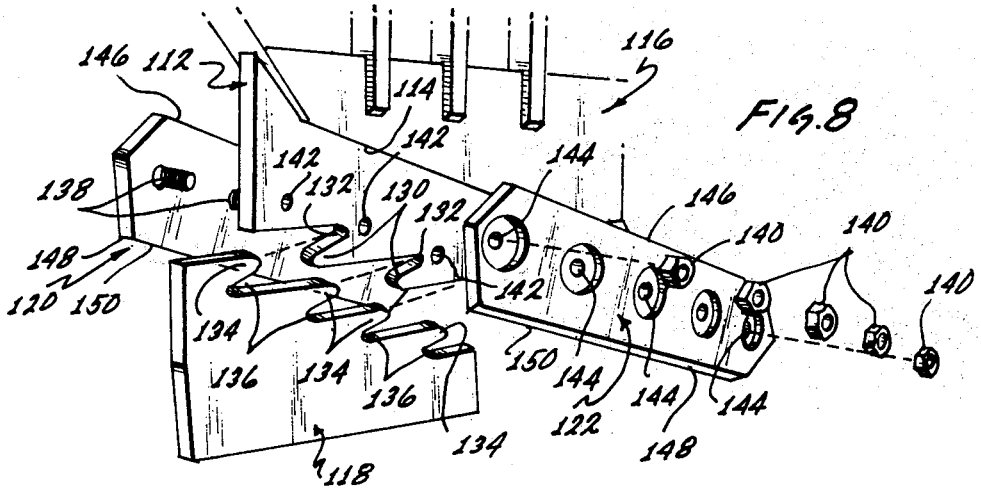
FIG. 8 is an exploded perspective view illustrating the component parts of the quick change replaceable router bit.

Turning now to FIGS. 7 and 8, the upper mounting member 112 has defined along its lower edge a plurality of downwardly and forwardly extending fingers 130, between which are defined finger apertures 132. The lower insert member 118 has defined along its upper edge a second plurality of fingers 134 between which are finger apertures 136. The fingers 134 extend upwardly and rearwardly and are shaped and configured so as to interlock with the fingers and finger apertures of the upper mounting member 112 as illustrated in dotted lines in FIG. 7. As best appreciated in FIG. 7, the rearward and upward loads imposed on thr insert 118 force the fingers into tighter interlocking engagement. The insert 118 is retained to the mounting member 112 by a pair of elongated side plates 120, 122 bolted to the mounting member 112 by means of a series of mounting bolts 138 which extend through holes 142 in the mounting member 112 and aligned with holes 144 in the side plates each bolt being secured by a corresponding nut 140.

Each side plate 120, 122 has a long upper edge 146 and a long lower edge 148 which may be parallel with the upper edge. The length of the side plates desirably extends across all of the interlocking fingers of the insert and mounting member i.e., from front to rear of the router bit, and the width of each side plate desirably at least covers the interlocked fingers 130, 134. It will be understood that while it is preferable to mount the side plates to the permamently attached mounting member 112, it is possible to construct a quick-change router bit with the side plates mounted to the insert 118.

Figure 9:
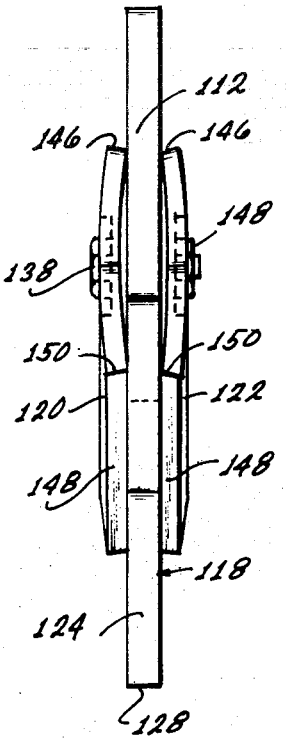
FIG. 9 is a front elevational view of the assembled router bit.

Turning now to FIG. 9, it is seen that the side plates 120 and 122 seen edge-on from the front of the router bit are crowned or bowed in a vertical direction, that is, between the upper edge 146 and lower edge 148. The plates are otherwise straight along their long dimension, i.e., from front to rear of the router bit. The side plates are therefore concavely curved on the side facing the mounting member and the insert. The plates are preferably cut so as to form well-defined corners 150 at the intersection between the upper and lower edge surfaces 146, 148 and the concave inner surfaces of the side plates. These corners 150 desirably extend the full length of the upper and lower edges of the side plates. The side plates are fastened to the mounting member 112 by means of the mounting bolts and nuts 138, 140, respectively, which extend through bolt holes 144 situated generally midway between the upper and lower edges 146, 148. When the mounting bolts are tightened, inward pressure is applied to the corners 150, causing the relatively sharp corner lines along the lower edges 148 of the side plates to bite into the side surfaces of the lower insert 118.

The corner lines 150 slant upwardly in a forward direction so as to lie generally transversely to the direction of disengagement between the insert 118 and the mounting member 112. This direction of disengagement is generally suggested by the dotted lines in FIG. 8 connecting the fingers 134 of the insert 118 to corresponding finger apertures 132 of the mounting member 112. The angle of the corner lines 150 relative to the direction of the interlocking fingers 132, 134 may fall within a relatively wide range. Maximum retention of the insert by the clamping action of the side plates will be obtained when the corner lines 150 lie perpendicular to the direction of the interlocking fingers 132, 134. Departures from such a perpendicular relationship will normally provide adequate retaining force through a relatively wide range of angles.

All components of the quick change replaceable router can be made by cutting relatively inexpensive flat sheet stock, such as steel plate. Further, plate of similar thickness may be used for all components to minimize cost and complexity of of manufacture. The various parts may be flame cut by means of photocell guided automatic cutting torches. It will be appreciated that no welding of parts is required except for attachment of the mounting member 112 to a particular piece of earth-moving equipment. The crowning of the side plates 120, 122 may be accomplished with the aid of a press or any other suitable method. The bolt holes may be drilled with conventional drills, or may be flame cut with a torch.

It will, thus, be apparent to those skilled in the art that various changes, modifications and alterations may be made to the router bit herein disclosed, or to parts thereof, or to the method of making the same without departing from the scope of the present invention as set forth in the appended claims.

I claim:

1. A router bit for use with earth moving equipment comprising:

a first member having a forward end and a rear end and being adapted to be mounted on said earth moving equipment;

a lower insert including a portion defining an earth cutting edge;

said first member having a first plurality of downwardly and forwardly extending finger means and finger apertures, said lower insert having a second plurality of finger means and finger apertures extending upwardly and rearwardly, said first and second pluralities interlocking to prevent upward and rearward movement of said insert relative to said first member; and retainer means comprising at least one pair of side plates releasably affixed in opposing relationship to opposite sides of one of said first member or said insert, each side plate having an upper edge and a lower edge, said side plate being crowned concavely in a direction generally transverse to both said edges, each side plate being affixed with its concave side facing said first member and with said upper edge lying against said first member and said lower edge against said insert such that said lower edges clamp said insert against separation from said first member.

2. The router bit of claim 1 wherein said lower edge lies at an angle to the direction of disengagement of the insert from the first member.

3. The router bit of claim 1 wherein said mounting means comprises bolt means passing through said plate means intermediate said upper and lower edges such that when tightened the bolts tend to flatten the crowned side plate against said interlocked first member and insert so that said edges bite into at least said insert.

4. The router bit of claim 1 wherein said side plates have a plate thickness substantially equal to that of both said first member and said inserts.

5. The router bit of claim 1 wherein said first and second plurality of interlocking finger means lie at an angle of approximately 45 degrees relative to said earth cutting edge.

6. A router bit for use with earth moving equipment comprising:

a first member having a forward end and a rear end and being adapted to be mounted on said earth moving equipment;

a lower insert including a portion defining an earth cutting edge;

said first member having a first plurality of downwardly and forwardly extending finger means and finger apertures, said lower insert having a second plurality of finger means and finger apertures extending upwardly and rearwardly, said first and second pluralities interlocking to prevent upward and rearward movement of said insert relative to said first member, both said insert and said member being formed as flat plate units; and retainer means releasably affixed to one of said first member or said insert and retaining the other of said first member or said insert by clamping force against lateral, forward and downward movement of said insert relative to said first member.

7. The router bit of claim 9 wherein said first member and said insert are flat plates of substantially equal thickness.

8. The router bit of claim 7 wherein said retainer means are elongated plates perforated for receiving mounting bolts extending through aligned openings in one of said first member or insert.

9. A router bit for use with earth moving equipment comprising:

a first member having a forward end and a rear end and being adapted to be mounted on said earth moving equipment;

a lower insert including a portion defining an earth cutting edge;

said first member having a first plurality of downwardly and forwardly extending finger means and finger apertures, said lower insert having a second plurality of finger means and finger apertures extending upwardly and rearwardly, said first and second pluralities interlocking to prevent upward and rearward movement of said insert relative to said first member; and retainer means releasably affixed to one of said first member or said insert and retaining the other of said first member or said insert by clamping force against lateral, forward and downward movement of said insert relative to said first member;

said retainer means comprising two side plates, each having parallel upper and lower edges, said plates being releasably mounted to opposite sides of said first member with said lower edges lying at an angle of between 10 and 80 degrees to the direction of disengagement between the insert and first member.

10. A router bit for use with earth moving equipment comprising:

a first member having a forward end and a rear end and being adapted to be mounted on said earth moving equipment;

a lower insert including a portion defining an earth cutting edge;

said first member having a first plurality of downwardly and forwardly extending finger means and finger apertures, said lower insert having a second plurality of finger means and finger apertures extending upwardly and rearwardly, said first and second pluralities interlocking to prevent upward and rearward movement of said insert relative to sid first member; and retainer means releasably affixed to one of said first member or said insert and retaining the other of said first member or said insert by clamping force against lateral, forward and downward movement of said insert relative to said first member;

said retainer means comprising at least one pair of side plates mounted to opposite sides of one of said first member or said insert, each side plate having inturned edge portions engaging the other of said first member or said insert in clamping relationship to prevent separation of said insert from said first member.

11. A method for making a quick change replaceable router bit for use with earth moving equipment comprising the steps of:

cutting flat plate stock to make a first member having a forward end, a rear end and an upper portion adapted to be mounted to said earth moving equipment, said first member having a first plurality of downwardly and forwardly extending finger means and finger apertures defined there between;

cutting flat plate stock to make a lower insert including at least one earth cutting edge, said lower insert having a second plurality of finger means and finger apertures defined there between, said finger means extending upwardly and rearwardly and interlocking with said first plurality of finger means and finger apertures;

cutting flat plate stock to make at least one pair of side plates;

forming inturned portions on said side plates;

mounting said side plates to opposite sides of one of said first member or said insert such that said inturned portions engage the other of said first member of said insert in clamping relationship to prevent separation of said insert from said first member.

12. The method of claim 11 wherein said step of forming said inturned portions comprises the step of crowning said side plates such that edge portions of each side plate engages one or both of said first member and said insert.

13. The method of claim 11 wherein said side plates are cut such that corner edges are formed at the intersection of the concave side of the crowned plate and the edge surfaces of the side plate, such that the corner edges bite into one or both of the first member and the insert to more positively retain the insert to the first member.

14. The method of claim 11 wherein said first member, said insert and said side plates are cut from similar flat plates which are cut from similar flat plate stock.

15. The method of claim 11 wherein one or more of said cutting steps are carried out by flame cutting the flat plate stock.

16. The method of claim 15 wherein said flame cutting is carried out by a photocell guided cutting torch.

17. The method of claim 11 wherein said side plates are mounted to said first member and said insert is retained solely by clamping force exerted by the side plates thereon.

18. The method of claim 11 wherein said side plates are mounted by means of a plurality of mounting bolts and corresponding nuts.

19. The method of claim 11 wherein said first member, said insert, and said side plates are cut from flat metal plate.

* * * * *